US007073853B2

(12) United States Patent
Onishi

(10) Patent No.: US 7,073,853 B2
(45) Date of Patent: Jul. 11, 2006

(54) CHAIR WITH DESK AND CHAIR WITH DESK INCLUDING BODY KEEPING APPARATUS

(75) Inventor: Teruhisa Onishi, Tsuyama (JP)

(73) Assignee: President of Tsuyama National College of Technology, Tsuyama (JP)

( * ) Notice: Subject to any disclaimer, the term of this patent is extended or adjusted under 35 U.S.C. 154(b) by 0 days.

(21) Appl. No.: 10/863,206

(22) Filed: Jun. 9, 2004

(65) Prior Publication Data

US 2004/0222677 A1 Nov. 11, 2004

Related U.S. Application Data

(62) Division of application No. 10/346,122, filed on Jan. 17, 2003, now Pat. No. 6,776,452.

(30) Foreign Application Priority Data

Aug. 30, 2002 (JP) ..... 2002-253790

(51) Int. Cl.
*A47B 83/00* (2006.01)
*A62B 35/00* (2006.01)

(52) U.S. Cl. ..... 297/170; 297/485

(58) Field of Classification Search ..... 297/173, 297/170, 172, 188.21, 464, 465, 467, 485; 108/143
See application file for complete search history.

(56) References Cited

U.S. PATENT DOCUMENTS

| | | | | |
|---|---|---|---|---|
| 183,323 | A * | 10/1876 | Park et al. | 108/25 |
| 993,493 | A | 5/1911 | Young | |
| 1,023,620 | A | 4/1912 | Burge | |
| 1,413,745 | A | 4/1922 | Leonard | |
| 2,168,910 | A | 8/1939 | Merrill | |
| 2,466,956 | A * | 4/1949 | Lambert | 297/138 |
| 2,664,147 | A * | 12/1953 | O'Keefe et al. | 297/172 |
| 2,716,440 | A | 8/1955 | Silverman | |
| 3,601,443 | A | 8/1971 | Jones | |
| 3,761,126 | A * | 9/1973 | Mulholland | 297/467 |
| 4,165,127 | A * | 8/1979 | Vago | 297/344.18 |
| 4,647,066 | A * | 3/1987 | Walton | 297/284.1 |
| 5,169,210 | A | 12/1992 | Fricano | |
| 5,454,581 | A | 10/1995 | Ringer | |
| 5,588,697 | A | 12/1996 | Yoshida et al. | |
| 5,601,331 | A | 2/1997 | Austin, Jr. et al. | |
| 5,669,671 | A * | 9/1997 | Laco | 297/485 |
| 5,931,539 | A * | 8/1999 | Saiz | 297/465 |
| 6,105,184 | A | 8/2000 | Onishi | |
| 6,422,646 | B1 | 7/2002 | McNally | |

FOREIGN PATENT DOCUMENTS

EP 347212 A2 * 12/1989

* cited by examiner

*Primary Examiner*—Peter M. Cuomo
*Assistant Examiner*—Sarah B. McPartlin
(74) *Attorney, Agent, or Firm*—Oblon, Spivak, McClelland, Maier & Neustadt, P.C.

(57) ABSTRACT

A chair with a desk includes a chair body having a support leg and a seat section mounted on the support leg such that the level of the seat section is adjustable, a support member coupled to the chair body turnably within a horizontal plane, a desk body which is provided for the support member and a position of which is adjustable back and forth with respect to the chair body, a rest provided for the desk body and including a storage, and a drawer type rest which is allowed to be drawn from the rest in a lateral direction.

12 Claims, 10 Drawing Sheets

CHAIR WITH DESK AND CHAIR WITH DESK INCLUDING BODY KEEPING APPARATUS

CROSS-REFERENCE TO RELATED APPLICATIONS

This application is based upon and claims the benefit of priority from the prior Japanese Patent Application No. 2002-253790, filed Aug. 30, 2002, the entire contents of which are incorporated herein by reference.

BACKGROUND OF THE INVENTION

1. Field of the Invention

The present invention relates to a chair with a desk that is convenient to a user who uses a notebook personal computer or the like on the desk and a chair with a desk including a body keeping apparatus that is convenient to a handicapped person who operates a notebook personal computer and conducts work on the desk.

2. Description of the Related Art

There are chairs with a desk in classrooms of a school and the like. The size of a top serving as a rest of each chair with a desk is the same as that of B-type-size paper. Currently, A-type-size paper is recommended on a global basis; however, the top of a chair with a desk is still the size corresponding to that of B-type-size paper.

If the size of the top is changed to that of A-type-size paper, a classroom has to be altered in terms of space. Under the circumstances, the size is not changed.

Computers such as notebook personal computers have recently been used in classrooms in accordance with the spread of information technology (IT). Each of students in the classrooms frequently operates a notebook personal computer on the top of a chair with a desk. However, the size of the top of such a prior art chair with a desk is inadequate for students who take a course and study while putting an A4-size notebook personal computer, an A5-size textbook and an A5-sized notebook on the top of the desk.

As described above, not only the tops of the prior art chairs with a desk used in a classroom are small in size, but also they do not meet the demands of the times. Furthermore, none of the prior art chairs are designed in consideration of handicapped persons who operate the notebook personal computers and conduct work while sitting on the chairs. Chairs with a desk should be prepared exclusively for the handicapped. In particular, a severely handicapped person requires such a chair with a desk that he or she can operate a notebook personal computer and conduct work on the desk while he or she is seated in the chair with stability.

BRIEF SUMMARY OF THE INVENTION

The present invention has been developed in consideration of the above situation. An object of the present invention is to provide a chair with a desk which is convenient to a user who operates a notebook personal computer on the desk and takes a course and studies while putting a textbook and a notebook on the desk and which is capable of reducing fatigue because the user can sit on the chair in a proper position.

Another object of the present invention is to provide a chair with a desk including a body keeping apparatus that is capable of keeping the body of a handicapped person in a stable state when the person operates a notebook personal computer and conducts work on the desk.

According to a first aspect of the present invention, there is provided a chair with a desk, comprising a chair body, a support member coupled to the chair body turnably within a horizontal plane, a desk body provided for the support member, a position of the desk body being adjustable back and forth with respect to the chair body, a rest provided for the desk body and including a storage, and a drawer type rest which is allowed to be drawn from the rest in a lateral direction.

According to a second aspect of the present invention, there is provided a chair with a desk, including a body keeping apparatus, comprising a chair body, a body keeping apparatus provided for the chair body to keep a body, a support member coupled to the chair body turnably within a horizontal plane, a desk body provided for the support member, a position of the desk body being adjustable back and forth with respect to the chair body, a rest provided for the desk body and including a storage, and a drawer type rest which is allowed to be drawn from the rest in a lateral direction.

According to a third aspect of the present invention, there is provided a chair with a desk, including a body keeping apparatus, comprising a chair body including casters, a body keeping apparatus provided for the chair body to keep a body, a support member coupled to the chair body turnably within a horizontal plane, a desk body provided for the support member, and at least a pair of omnidirectional mobile units arranged from side to side on the chair body and freely moved on a floor, wherein the pair of omnidirectional mobile units includes at least a pair of motors which rotate forward and backward, wheels which roll and move on the floor by the motors, direction changing mechanism for rotatably supporting the motors and the wheels together as one component, and control mechanism for driving the motors independently of each other.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will now be described with reference to the accompanying drawings.

Figure 1:
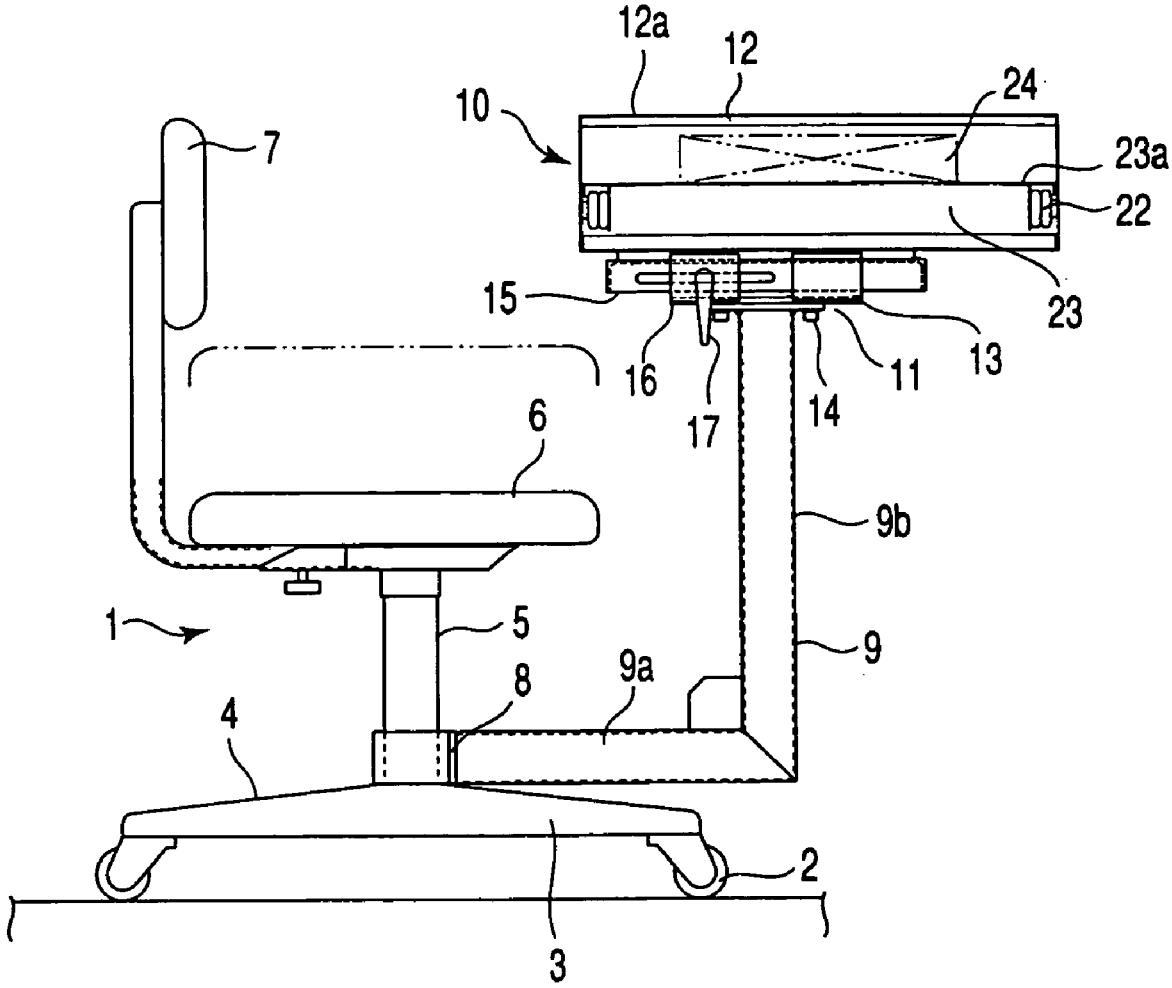
FIG. 1 is a side view of a chair with a desk according to a first embodiment of the present invention.
Figure 2:
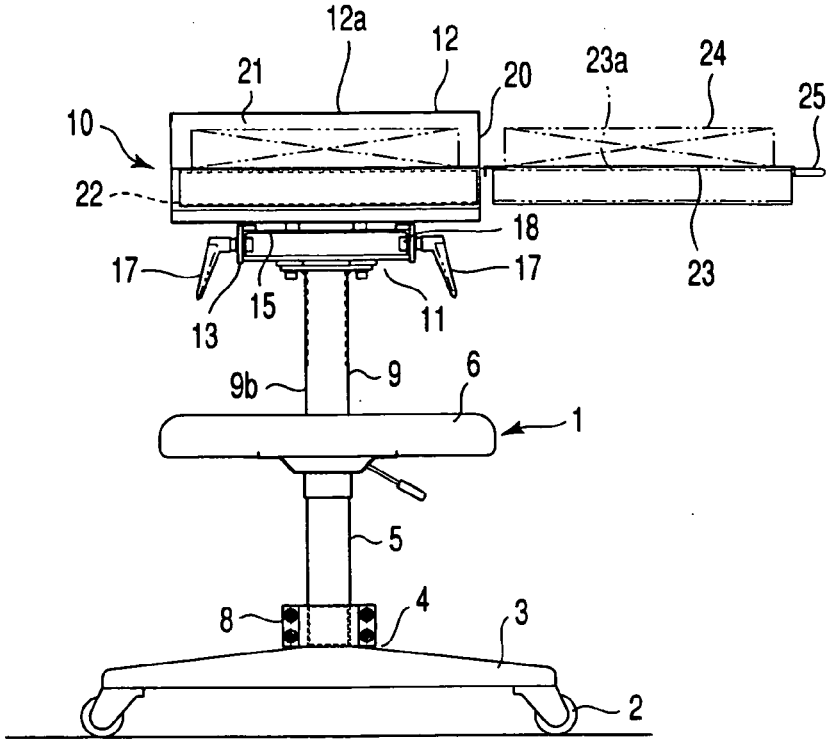
FIG. 2 is a front view of the chair with a desk according to the first embodiment.
Figure 3:
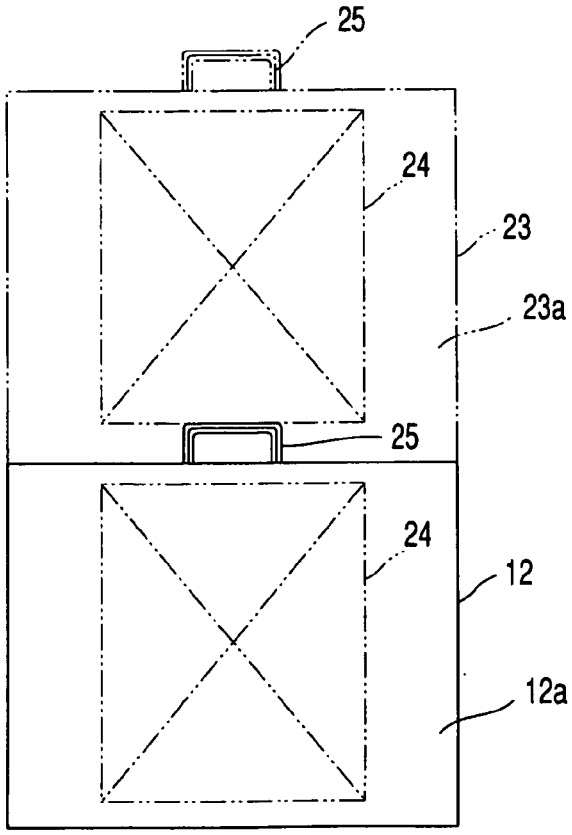
FIG. 3 is a plan view of a rest of the chair according to the first embodiment.

FIGS. 1 to 3 illustrate a chair with a desk according to a first embodiment of the present invention. The chair is used in a classroom of a school and the like.

A chair body 1 comprises a support leg 4 including a plurality of support arms 3 each having a caster 2, a column 5 formed on the support leg 4 in the vertical direction, a seat section 6 formed on the column 5, and a back section 7.

The column 5 freely rotates around the axis of the support leg 4. The directions of the seat and back sections 6 and 7 can arbitrarily be controlled, and so can be the levels of these sections 6 and 7 with respect to the support leg 4.

A desk support member 9 is fixed to the column 5 of the chair body 1 by means of a bracket 8. A desk body 10 is provided for the desk support member 9. The desk support member 9 is shaped like a letter "L" including a horizontal section 9*a* and a vertical section 9*b*. The horizontal section 9*a* is fixed to the bracket 8. A rest 12 is formed on the vertical section 9*b* with a desk back-and-forth position adjustment apparatus 11 interposed therebetween.

As for the apparatus 11, a fixed rail 13 is fixed to the vertical section 9*b* of the desk support member 9 by means of a bolt 14. The fixed rail 13 includes a movable rail 15 that freely moves in the back-and-forth direction of the chair body 1. A hole 16 expanded in the back-and-forth direction of the chair body 1 is formed in either side of the movable rail 15. The fixed rail 13 also includes a turnable lock lever 17.

The lock lever 17 includes a bolt 18 that passes through the expanded hole 16 from inside the movable rail 15 and protrudes from the fixed rail 13. A screw portion (not shown) of a distal end of the lock lever 17 is secured to the bolt 18. Thus, the screw portion is screwed into the bolt when the lock lever 17 turns, and the movable rail 15 can be fixed to the fixed rail 13. In other words, a user can adjust the back-and-forth position of the rest 12 of the desk body 10 to a desired one while the user is seated on the seat section 6 of the chair body 1. If the lock lever 17 turns to a locking position after the adjustment, the movable rail 15 can be locked such that it cannot be moved.

The rest 12 is mounted on the movable rail 15. The rest 12 is rectangular and shaped like a box. The rest 12 includes a storage 21 having an opening 20, for example, on its left side only. An extendable rail 22 is fixed in each of the front and back of a lower stage in the storage 21. The extendable rail 22 supports a drawer type rest 23, which is drawn from the opening 20 of the rest 12 in the lateral direction. In other words, the drawer type rest 23 can be drawn toward the side of the rest 12 from the storage 21 while it is supported by the extendable rail 22. If the drawer type rest 23 is drawn out, the area of the entire rest can be increased due to both the top surfaces 12*a* and 23*a* of the rest 12 and drawer type rest 23.

As shown in FIG. 3, the area of the rest 12 so configured is approximately doubled if the drawer type rest 23 is drawn out. Therefore, a user can put, for example, a notebook personal computer 24 on the top of the drawer type rest 23 and put, for example, a textbook and/or a notebook, writing materials and the like on the top of the rest 12. The user can obtain enough space to operate the notebook personal computer 24 and take a course and study while putting the textbook and notebook thereon. Since, moreover, the user can be kept in a good position, his or her fatigue can be reduced.

A handle 25 is provided at the end of the drawer type rest 23. A user can hold the handle 25 to draw out the rest 23 and store it into the storage 21. When the notebook personal computer 24 is not needed, the drawer type rest 23 can be stored in the storage 21 with the computer 24 thereon. Thus, the notebook personal computer 24 can be stored in the storage 21, too.

Consequently, when the notebook personal computer 24 is not needed, it can be stored together with the drawer type rest 23. The desk body 10 can be made compact and thus does not become an obstacle. If, moreover, the storage 21 is locked when the need arises, the computer can be protected from theft.

A chair with a desk including a body keeping apparatus according to a second embodiment of the present invention will now be described.

Figure 4A:
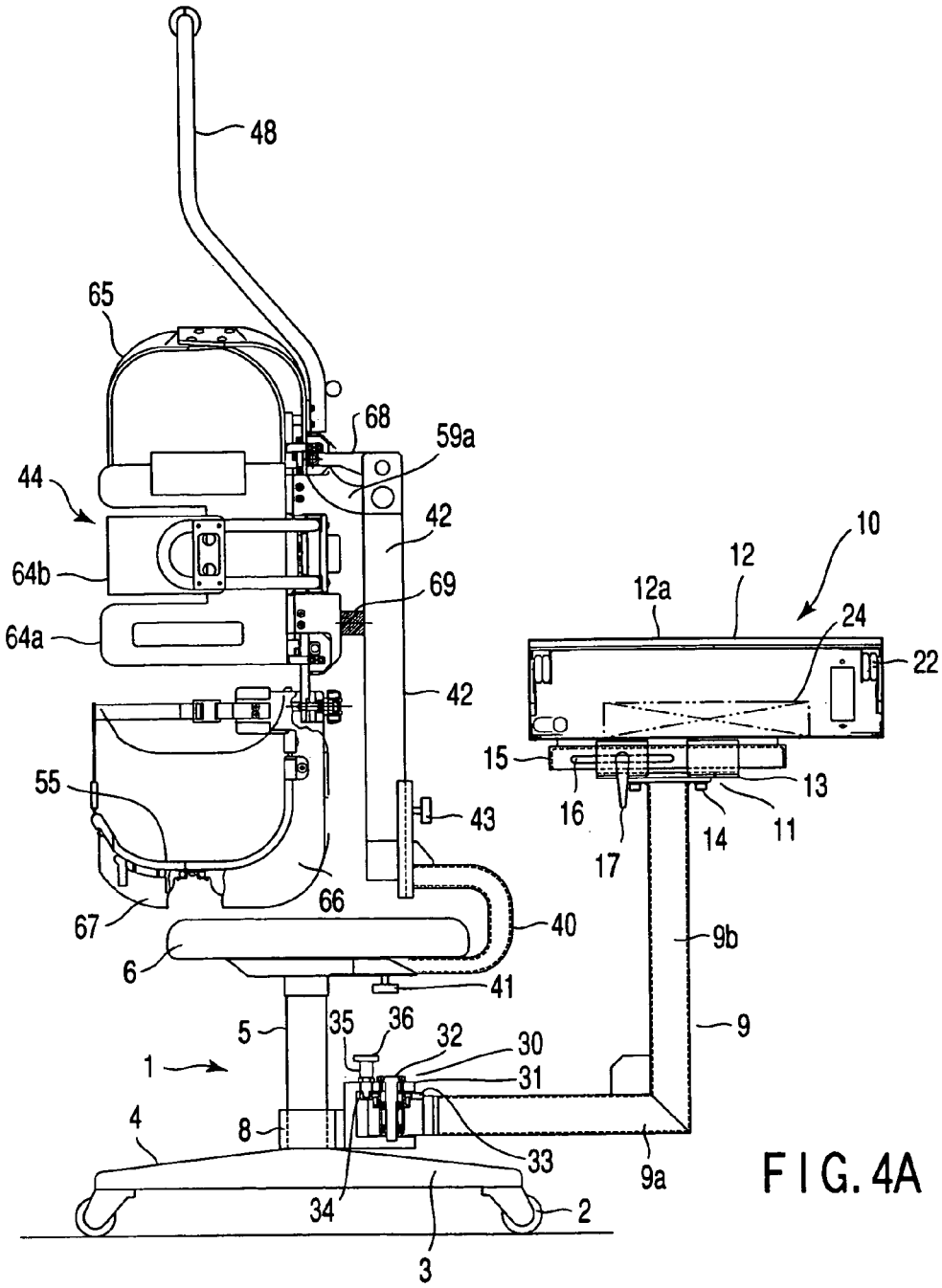
FIG. 4A is a side view of a chair with a desk including a body keeping apparatus according to a second embodiment of the present invention.
Figure 4B:
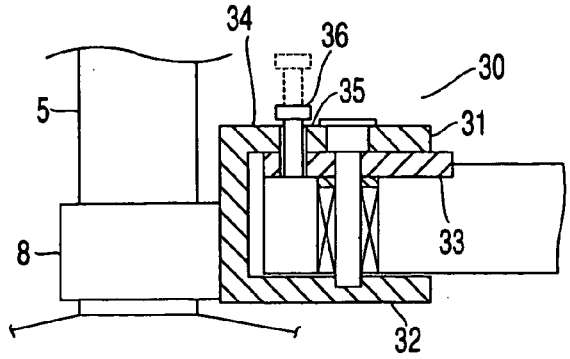
FIG. 4B is an enlarged cross-sectional view of a desk angle control apparatus of the chair according to the second embodiment.
Figure 5:
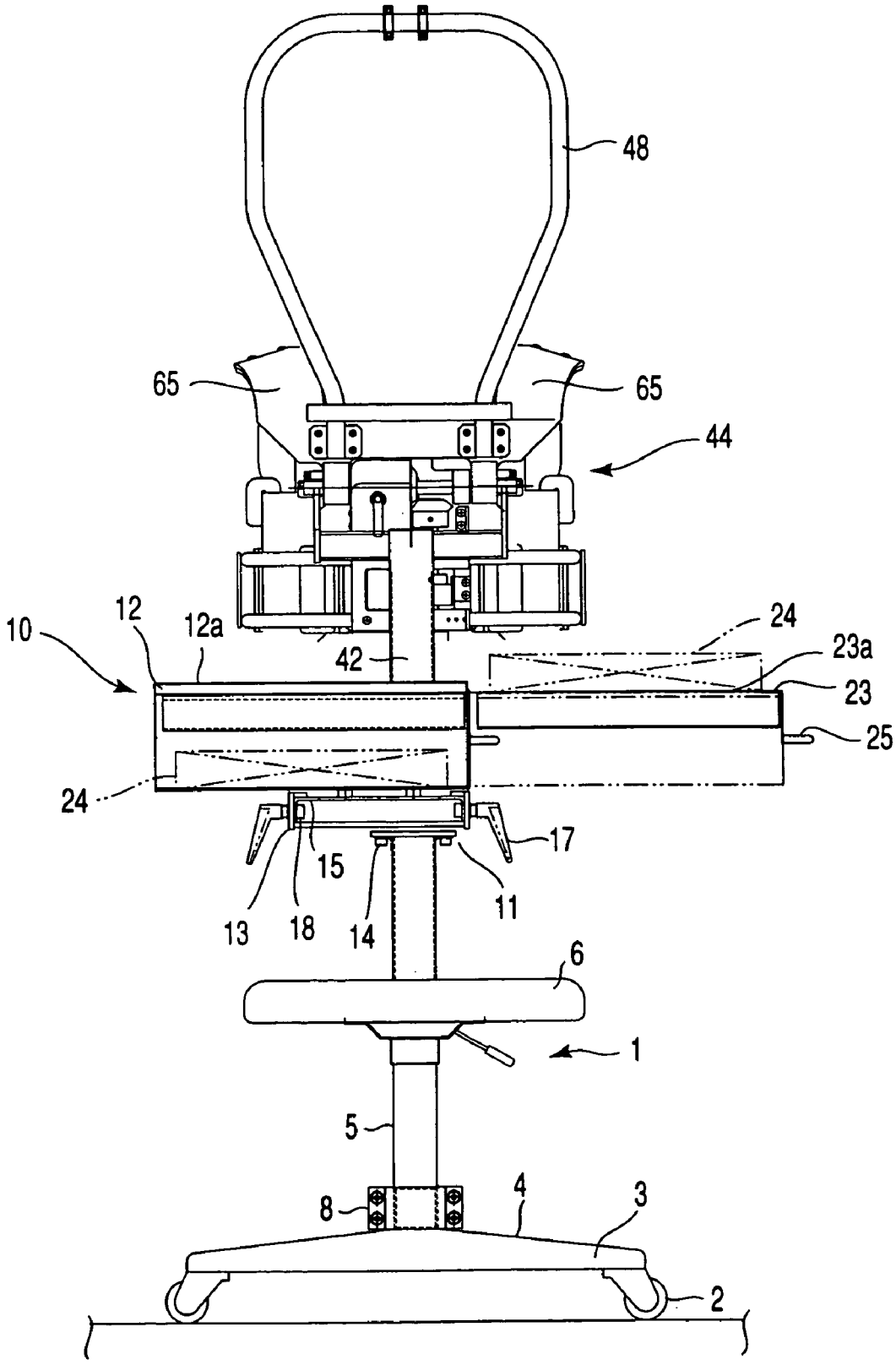
FIG. 5 is a front view of the chair with a desk including a body keeping apparatus according to the second embodiment.
Figure 6:
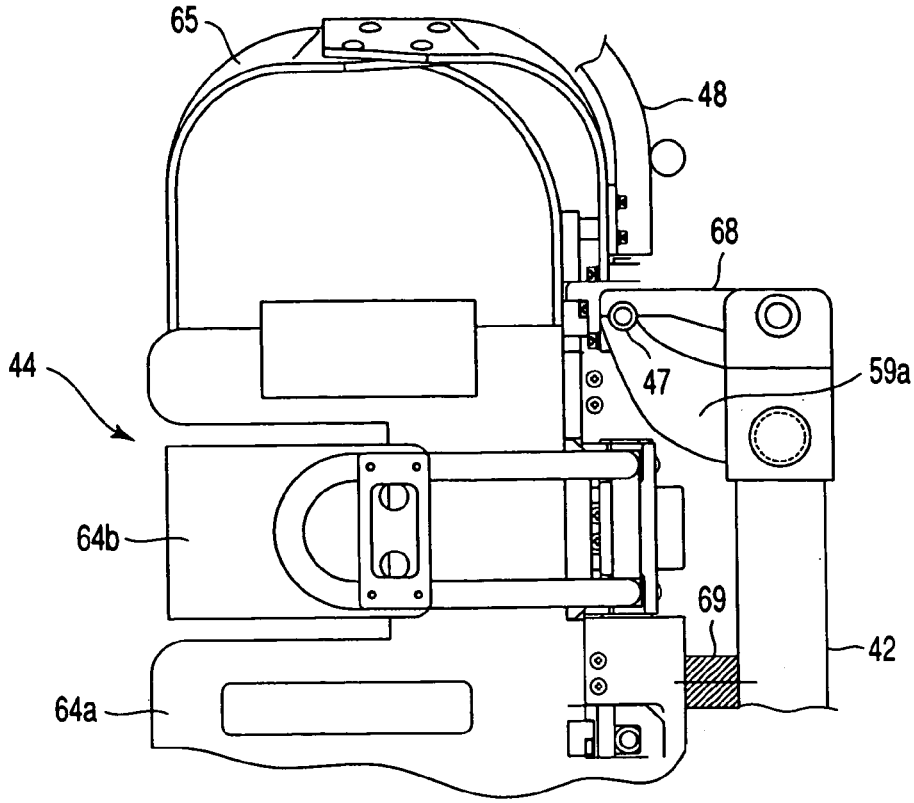
FIG. 6 is a side view of a body keeping apparatus fixing hook of the chair according to the second embodiment.
Figure 7:
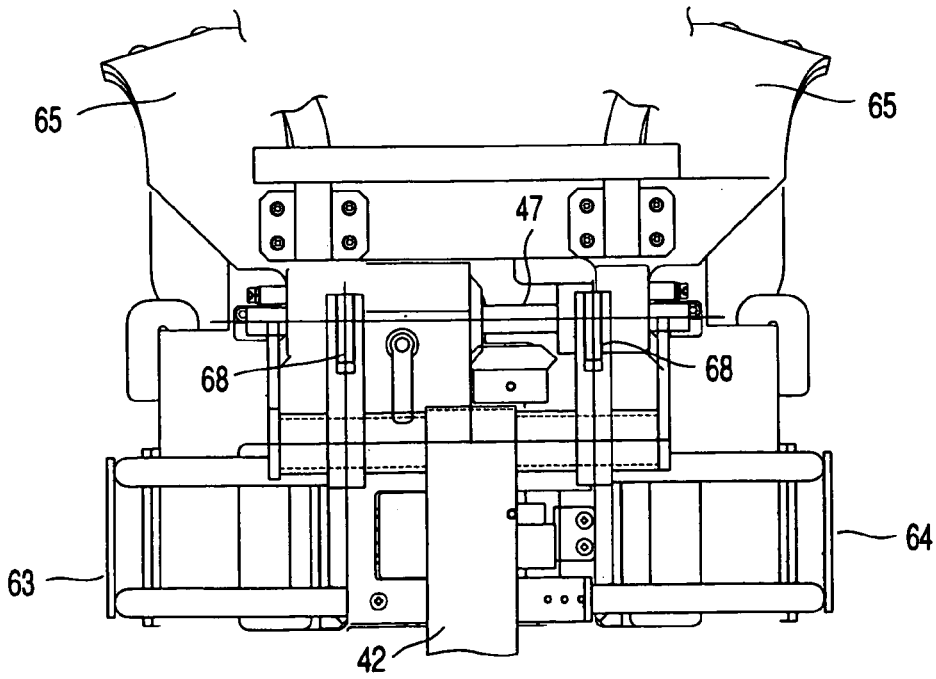
FIG. 7 is a front view of the body keeping apparatus fixing hook of the chair according to the second embodiment.

Referring to FIGS. 4A, 4B and 5, a desk body 10 is connected to a bracket 8 provided for a column 5 of a chair body 1 through a desk angle adjustment apparatus 30. In the apparatus 30, a fixed member 31, which is shaped like a Japanese character "コ", is provided for the bracket 8. A main shaft 32 is fixed in the central part of the fixed member 31 in the vertical direction. A rotating disk 33 is so provided that it can freely rotate around the main shaft 32 while being clamped by the fixed member 31 from above and below.

The rotating disk 33 has a plurality of fitting holes 34 that are arranged at regular intervals along the circumference of a circle with the main shaft 32 at the center thereof. A single through hole 35 is formed in the top surface of the fixed member 31 so as to correspond to one of the fitting holes 34. A fitting pin 36 can be inserted into and extracted from the through hole 35 in the vertical direction.

The same horizontal section 9*a* of the desk support member 9 as in the first embodiment is fixed to the rotating disk 33. The desk body 10 is provided for the vertical section 9*b* of the desk support member 9. The member 9 can thus freely turn around the main shaft 32 within the horizontal plane. If a rest 12 of the desk body 10 is positioned at an arbitrary angle with respect to the chair body 1 and then the fitting pin 36 is inserted into one of the fitting holes 34, the desk support member 9 can be locked so as not to move within the horizontal plane. Consequently, a user can freely adjust the angle of the desk body 10 with respect to the chair body 1 to meet the user's needs.

The rest 12 is rectangular and shaped like a box. The rest 12 includes a storage 21 having an opening 20, for example, on its left side only. An extendable rail 22 is fixed in each of the front and back of an upper stage in the storage 21. The extendable rail 22 supports a drawer type rest 23, which is drawn from the opening 20 of the rest 12 in the lateral direction. In other words, the drawer type rest 23 can be drawn toward the side of the rest 12 from the storage 21 while it is supported by the extendable rail 22. If the drawer type rest 23 is drawn out, the top surfaces 12*a* and 23*a* of the rest 12 and drawer type rest 23 become substantially flush with each other and the area of the entire rest is approximately doubled.

According to the rest 12 so configured, a user can draw the drawer type rest 23 and put, for example, a notebook personal computer 24 on the top of the rest 23 and put, for example, a textbook and/or a notebook, writing materials and the like on the top of the rest 12. The user can obtain enough space to operate the notebook personal computer 24 and take a course and study while putting the textbook and notebook thereon. Since, moreover, the user can be kept in a good position, his or her fatigue can be reduced.

A body keeping apparatus 44 provided for the chair body 1 will now be described. A back section 7 of the chair body 1 is detached from a seat section 6. In place of the back section 7, one end portion of a mounting member 40 is fixed to the seat section 6 by means of a fixed screw 41. The mounting member 40 makes a detour around the front of the seat section 6 such that the other end portion thereof reaches above the seat section 6. A body keeping apparatus mounting member 42 is attached to the mounting member 40 above the seat section 6 in the vertical direction. The body keeping apparatus mounting member 42 is a prismatic or cylindrical rod-shaped body. The member 42 is detachably fastened to the mounting member 40 through a fastening screw 43 such that its level can be adjusted.

The body keeping apparatus mounting member 42 includes a body keeping apparatus 44 that is used when a handicapped person operates the notebook personal computer 24 on the rest 23 of the desk body 10 and takes a course with a textbook and a notebook on the rest 12.

Figure 8:
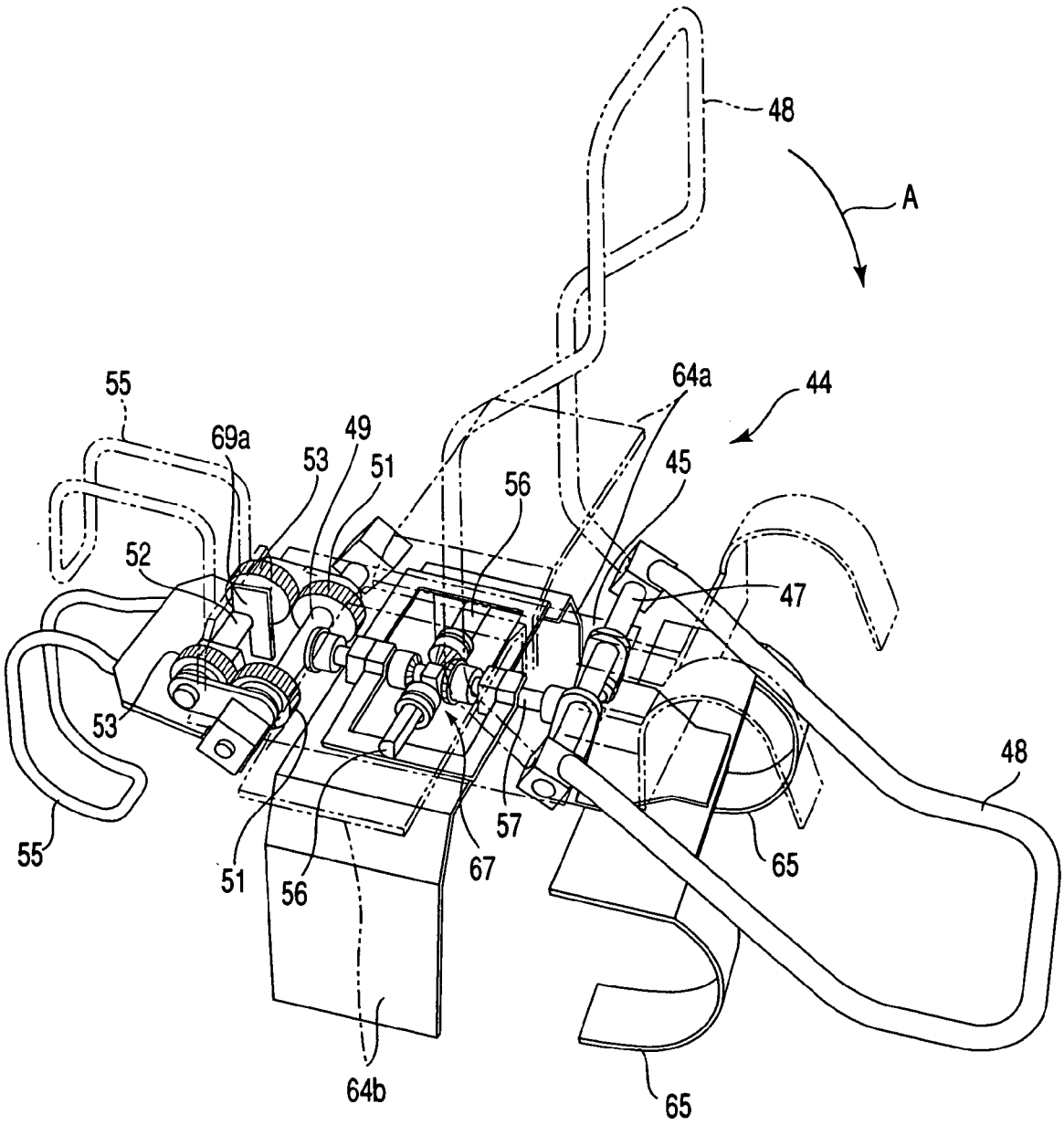
FIG. 8 is a perspective view of the body keeping apparatus of the chair according to the second embodiment.
Figure 9:
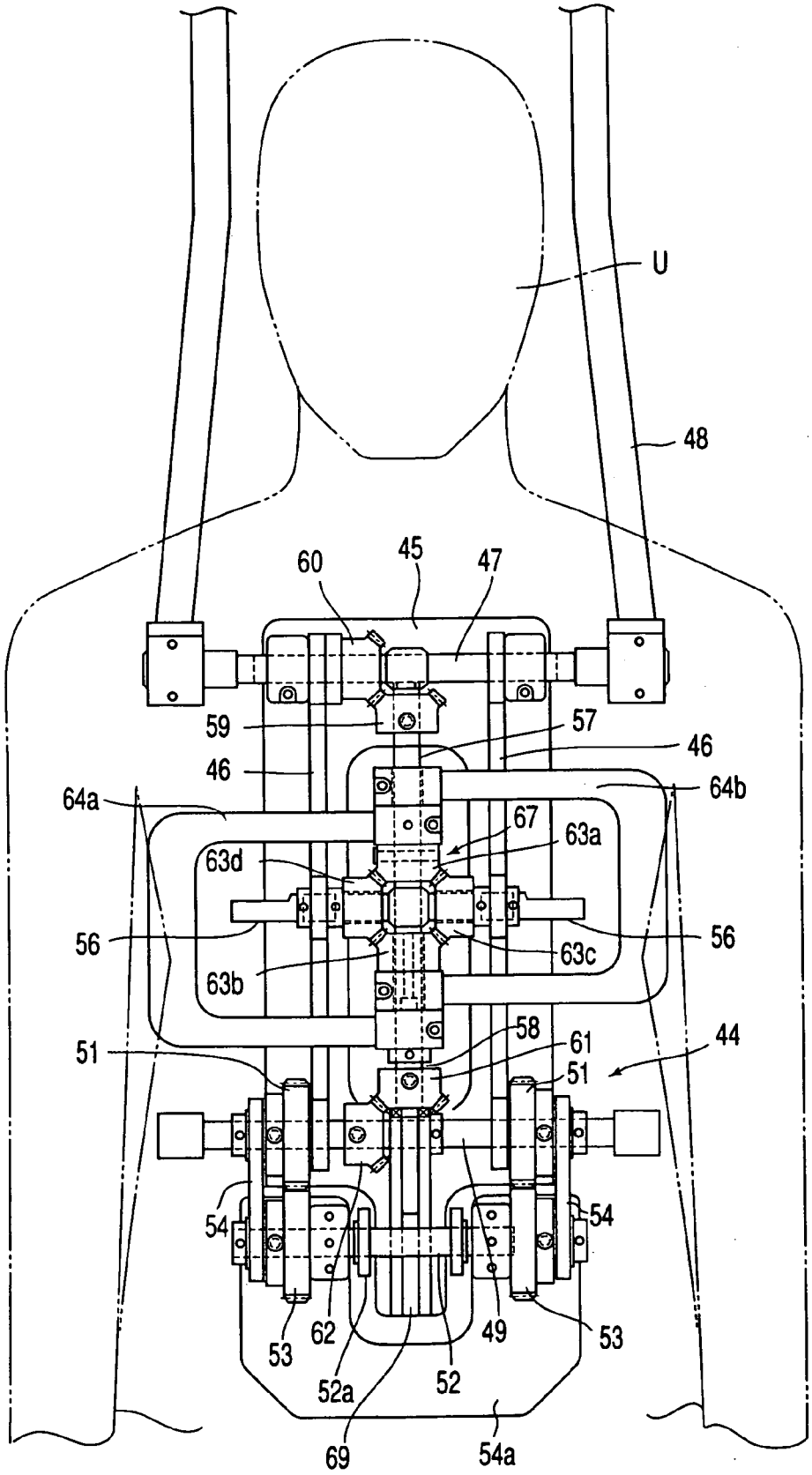
FIG. 9 is a front view of the body keeping apparatus of the chair according to the second embodiment.
Figure 10:
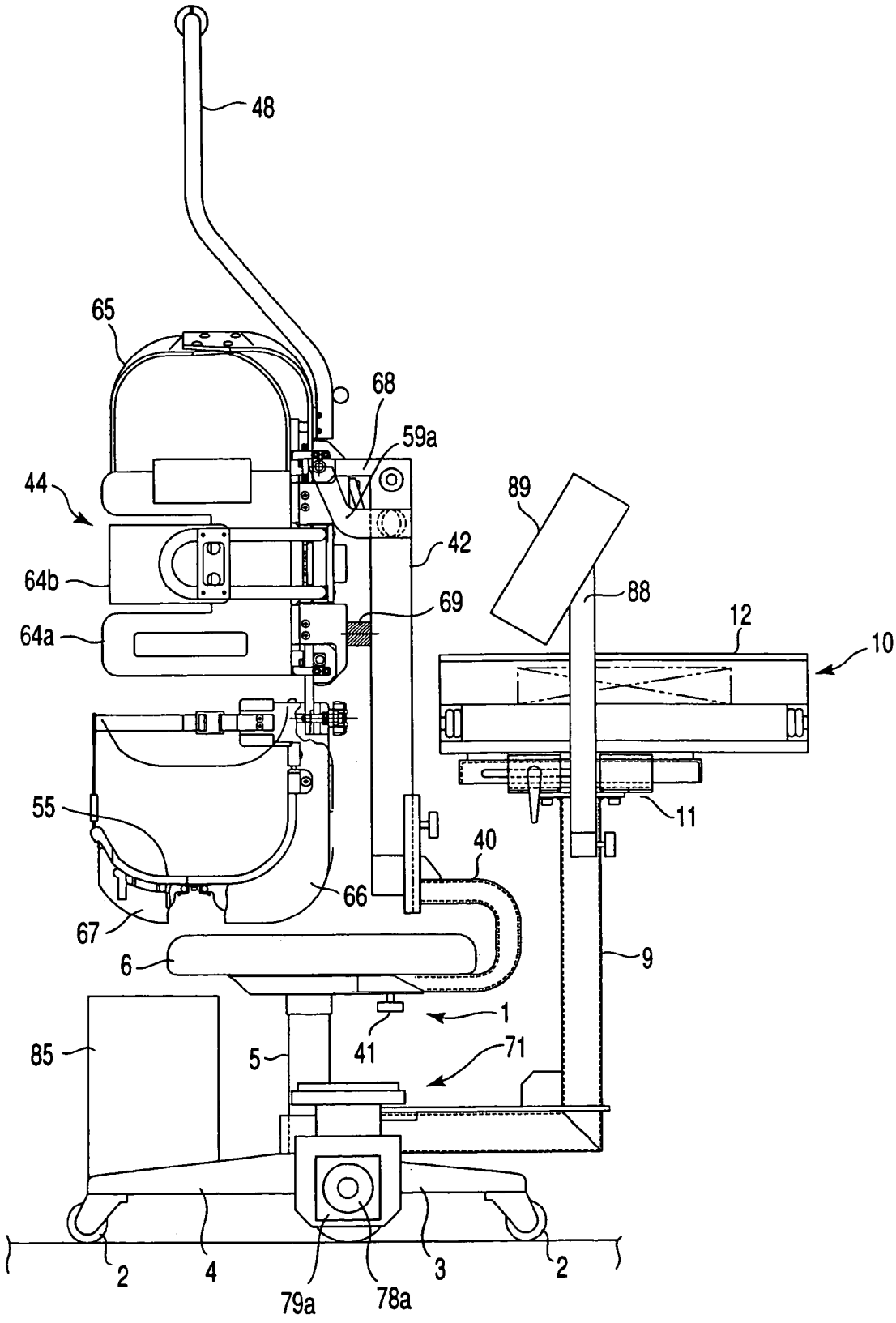
FIG. 10 is a side view of a chair with a desk including a body keeping apparatus having an omnidirectional mobile unit according to a third embodiment of the present invention.
Figure 11:
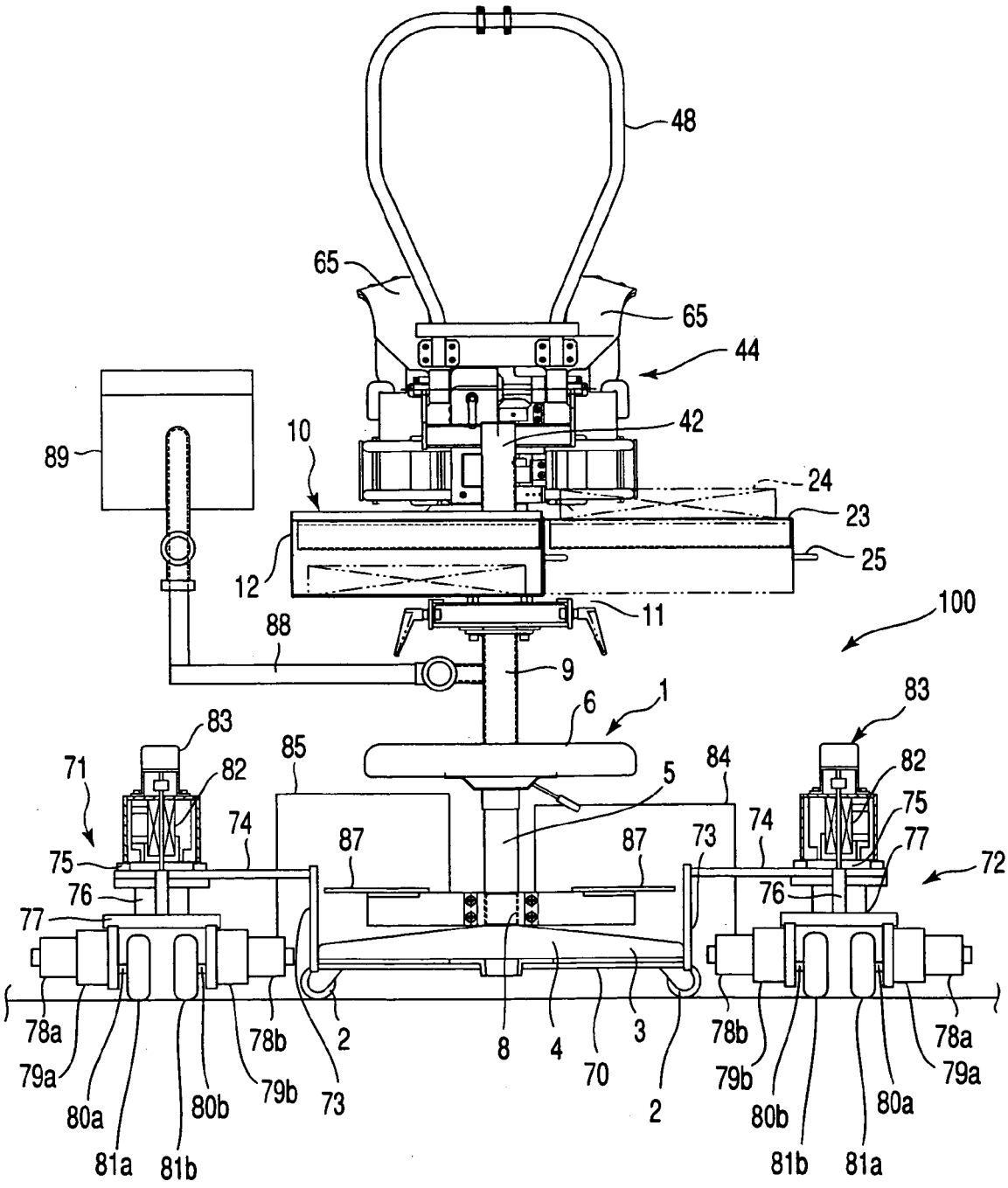
FIG. 11 is a front view of the chair with a desk including a body keeping apparatus having an omnidirectional mobile unit according to the third embodiment.
Figure 12:
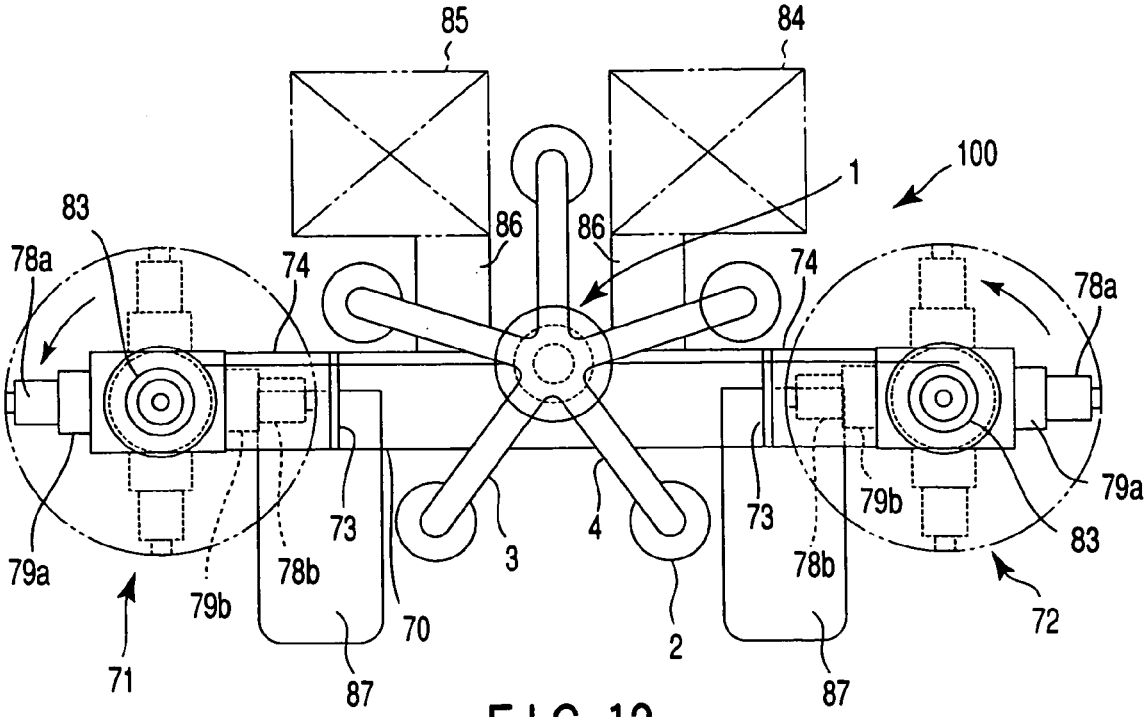
FIG. 12 is a plan view of the omnidirectional mobile unit of the chair according to the third embodiment.
Figure 13:
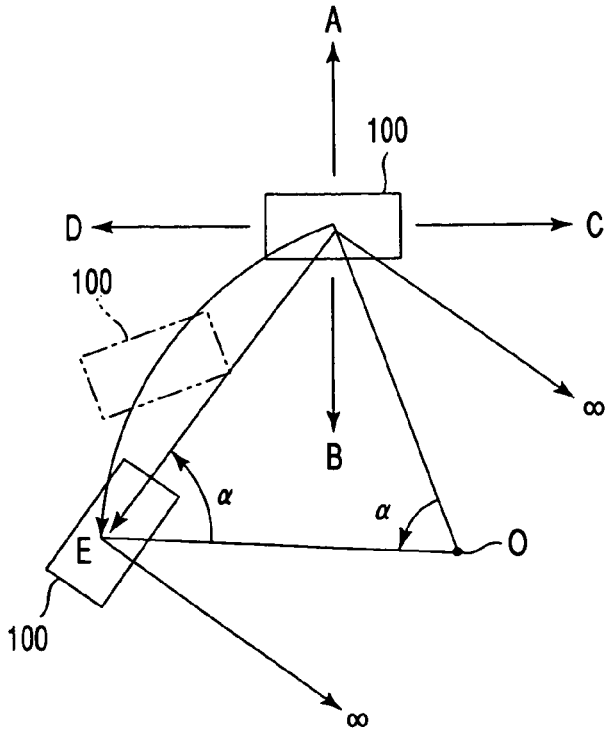
FIG. 13 is an illustration of functions of the chair according to the third embodiment.

The body keeping apparatus 44 includes a rectangular base plate 45 that is long in the vertical direction as shown in FIGS. 8 and 9. A pair of support members 46 is provided at the front of the base plate 45 and they are arranged along their respective sides of the base plate 45 in the vertical direction. Both ends of a main rotating shaft 47 are rotatably supported by their respective upper ends of the support members 46. Both ends of an inverted U-shaped main frame 48 are fixed to their respective ends of the main rotating shaft 47. Therefore, when a user rotates the main frame 48 by the hand, the main rotating shaft 47 rotates on its axis.

Both ends of a first driven rotating shaft 49 are rotatably supported by the lower ends of the support members 46, respectively. Driving gears 51 are fitted to the portions projected from the support members 46 at both ends of the first driven rotating shaft 49. One end portion of a turning plate 54 serving as a shaft support member is provided outside each of the driving gears 51. A second driven rotating shaft 52 is provided in parallel with the first driving rotating shaft 49 and rotatably supported between the other end portions of the turning plate 54.

A driven gear 53 is engaged with each of the driving gears 51 and fitted to the second driven rotating shaft 52. The turning plates 54 are fixed to the second driven rotating shaft 52. One end portion of a crotch support member 55 (described later) is fixed to each of the turning plates 54*a*. The crotch support member 55 is fixed to supports 52*a* that are provided with the bearings of the second driven rotating shaft 52. The turning plates 54*a* or crotch support member 55 can rotate irrespective of the first driven rotating shaft 49.

In FIG. 8, reference numeral 69*a* indicates a lock piece. When the crotch support member 55 is unlocked, it rotates around the second driven rotating shaft 52.

If the driving gears 51 rotate as the first driven rotating shaft 49 rotates, the driven gears 53, which are engaged with the driving gears 51, each rotate around the first driven rotating shaft 49 while rotating on its axis. Thus, the turning plates 54*a* and crotch support member 55 turn around the first driven rotating shaft 49.

A pair of support shafts 56 is provided from side to side between the main rotating shaft 47 and the first driven rotating shaft 49 in parallel with these shafts. The middle portions of the support shafts 56 are fixed to the support members 46. A first vertical rotating shaft 57 is provided halfway between the support members 46 and between the support shaft 56 and the main rotating shaft 47 in a direction perpendicular to these shafts. A second vertical rotating shaft 58 is provided between the support shaft 56 and the first driven rotating shaft 49 in a direction perpendicular to these shafts.

A first bevel gear 59 is fitted to the upper end portion of the first vertical rotating shaft 57 and engaged with a second bevel gear 60 that is fitted to the main rotating shaft 47. A third bevel gear 61 is fitted to the lower end portion of the second driven rotating shaft 58. The third bevel gear 61 is engaged with a fourth bevel gear 62 that is fitted to the first driven rotating shaft 49.

A fifth bevel gear 63*a* is fitted to the lower end portion of the first vertical rotating shaft 57, and a sixth bevel gear 63*b* is fitted to the upper end portion of the second vertical rotating shaft 57. Further, seventh and eighth bevel gears 63*c* and 63*d* that are engaged with the fifth and sixth bevel gears 63*a* and 63*b* are rotatably fitted to the inner end portions of the pair of support shafts 56. The fifth to eighth bevel gears 63*a* to 63*d* make up a differential mechanism 67.

The rotation of the main rotating shaft 47 is transmitted to the first vertical rotating shaft 57 through the first and second bevel gears 59 and 60. The rotation of the first vertical rotating shaft 57 is transmitted to the second vertical rotating shaft 58 through the differential mechanism 67. Furthermore, the rotation of the second vertical rotating shaft 58 is transmitted to the first driven rotating shaft 49 through the third and fourth bevel gears 61 and 62.

The distal ends of first and second trunk holding members 64*a* and 64*b*, each of which is formed of a plate-shaped body that is bent like a letter "L", are turnably supported by the first and second vertical rotating shafts 57 and 58, respectively. The distal end of the first trunk holding member 64*a* is coupled to the fifth bevel gear 63*a* composing the differential mechanism 67. The member 64*a* and gear 63*a* therefore turn together as one component. The distal end of the second trunk holding member 64*b* is coupled to the sixth bevel gear 63*b* composing the differential mechanism 67. The member 64*b* and gear 63*b* therefore turn together as one component. Consequently, the first and second trunk holding members 64*a* and 64*b* are turned together in opposite directions by the differential mechanism 67 to hold a user's trunk from both sides.

The distal ends of a pair of shoulder holding members 65, each of which is formed of a plate-shaped body that is curved like a letter "U", are fixed to the main rotating shaft 47. The shoulder holding members 65 turn together with the rotation of the main rotating shaft 47 and hang on user's shoulders.

The crotch support member 55 is formed of a rod-shaped body that is curved like a letter "U"and its distal end is fixed to the turning plates 54*a*. The member 55 turns together with the rotation of the second driven rotating shaft 52 and goes into a user's crotch to support the crotch. Referring to FIG. 4A, the crotch support member 55 includes detachable urination pot 66 and defecation pot 67 by which a user can urinate and defecate with the body keeping apparatus 4 on.

A pair of fixing hooks 68 is attached from side to side to the end portion of the body keeping apparatus mounting member 42, and these fixing hooks 68 are connected to both ends of the main rotating shaft 47. A contact member 69 protrudes from the mounting member 42 and contacts part of the body keeping apparatus 44, which is located under the fixing hooks 68. The body keeping apparatus 44 can thus be supported by the mounting member 42 by three members of the support member 59*a*, fixing hooks 68 and contact member 69. Therefore, the body keeping apparatus 44 is coupled to the body keeping apparatus mounting member 42 so as not to move in all directions.

The functions of the chair according to the second embodiment will now be described.

A user turns the main frame 48 around the main rotating shaft 47 by the hand to raise it almost perpendicularly to the base plate 45 as indicated by a two-dot-one-dash line in FIG. 8. As the main frame 48 turns, the main rotating shaft 47 rotates and its rotation is transmitted to the first vertical rotating shaft 57 through the first and second bevel gears 59 and 60. The rotation of the first vertical rotating shaft 57 is transmitted to the second vertical rotating shaft 58 through the differential mechanism 67, and the rotation of the second vertical rotating shaft 58 is transmitted to the first driven rotating shaft 49 through the third and fourth bevel gears 61 and 62.

If the driving gears 51 rotate as the first driven rotating shaft 49 does, the driven gears 53, which are engaged with the driving gears 51, each rotate around the first driven rotating shaft 49 while rotating on its axis. Thus, the turning plates 54*a* turn around the first driven rotating shaft 49.

As the main rotating shaft 47 rotates, the shoulder holding members 65 turn and open as indicated by another two-dot-one-dash line in FIG. 8. At the same time, the first trunk holding member 64*a* turns together with the fifth bevel gear 63*a* as one component and the second trunk holding member 64*b* turns together with the sixth bevel gear 63*b* as one component when the first and second vertical rotating shafts 57 and 58 rotate. Thus, the first and second trunk holding members 64*a* and 64*b* turn together in opposite directions at once and open to both sides, as indicated by another two-dot-one-dash line in FIG. 8. Moreover, when the second driven rotating shaft 52 rotates, the crotch support member 55 turns and opens as indicated by another two-dot-one-dash line in FIG. 8.

In order to hold a user U such as a handicapped person by the body keeping apparatus 44, the main rotating shaft 47 rotates as the main frame 48 turns in the direction of arrow A. The rotation of the main rotating shaft 47 is transmitted to the first vertical rotating shaft 57 through the first and second bevel gears 59 and 60. The rotation of the first vertical rotating shaft 57 is transmitted to the second vertical rotating shaft 58 through the differential mechanism 67. The rotation of the second vertical rotating shaft 58 is transmitted to the first driven rotating shaft 49 through the third and fourth bevel gears 61 and 62.

If the driving gears 51 rotate as the first driven rotating shaft 49 does, the driven gears 53, which are engaged with the driving gears 51, each rotate around the first driven rotating shaft 49 while rotating on its axis. Thus, the turning plates 54*a* turn around the first driven rotating shaft 49.

As the main rotating shaft 47 rotates, the shoulder holding members 65 turn and hang on the shoulders of the user U. At the same time, the first trunk holding member 64*a* turns together with the fifth bevel gear 63*a* as one component and the second trunk holding member 64*b* turns together with the sixth bevel gear 63*b* as one component when the first and second vertical rotating shafts 57 and 58 rotate. Thus, the first and second trunk holding members 64*a* and 64*b* turn in opposite directions at once to hold the trunk of the user U from both sides.

Moreover, as the second driven rotating shaft 52 rotates, the crotch support member 55 turns together and goes into the crotch of the user U to support the crotch.

Even though the user U is a handicapped person, he or she can be supported by the chair body 1 by holding his or her shoulders, trunk and crotch using the body keeping apparatus 44. Even in this state, the user U can move the arms and hands freely; therefore, the user U can operate the notebook personal computer 24 on the drawer type rest 23 of the desk body 1 and take a course and study with a textbook and a notebook on the rest 12.

FIGS. 10 to 13 illustrate a chair 100 with a desk including a body keeping apparatus having an omnidirectional mobile unit according to a third embodiment of the present invention. In the third embodiment, the same components as those of the first and second embodiments are denoted by the same reference numerals and their descriptions are omitted.

A support base 70 is detachably fixed to a support leg 4 of a chair body 1 and extends toward the right and left sides of a seat section 6. The support base 70 includes a right-hand mobile unit 71 at the right end and a left-hand mobile unit 72 at the left end when viewed from the back of the chair body 1.

One of the mobile units 71 and 72 will be described because they have the same structure. A vertical support plate 73 is fixed to the end of the support base 70 and extends in the vertical direction. A horizontal support plate 74 is connected to the vertical support plate 73 and extends outward in the horizontal direction.

The horizontal support plate 74 includes a bearing 75 by which a direction changing shaft 76 serving as a 360° rotatable direction changing means is supported in the vertical direction. A motor support member 77 is fixed to the lower end portion of the direction changing shaft 76. The motor support member 77 includes first and second motors 78*a* and 78*b* such as servo motors, which can be rotated in forward and backward directions. These motors 78*a* and 78*b* are opposed to each other with regard to an extension of the axis of the direction changing shaft 76 between them.

Output shafts 80*a* and 80*b* are connected to the first and second motors 78*a* and 78*b* through deceleration mechanisms 79*a* and 79*b*, respectively. Wheels 81*a* and 81*b*, which are made of rubber or the like and having the same ground contact face as that of casters 2 of the chair body 1, are fitted to the output shafts 80*a* and 80*b*, respectively. The wheels 81*a* and 81*b* are on the same level as that of the casters 2.

A wire (not shown) to supply power to the first and second motors 78*a* and 78*b* is electrically connected to a current collector 82 that is provided above the motor support member 77 through the direction changing shaft 76. Thus, even though the direction changing shaft 76 rotates 360°, power can be supplied to the first and second motors 78*a* and 78*b*. An encoder 83 is provided above the current collector 82 to detect an angle of rotation of the direction changing shaft 76.

The current collector 82 and encoder 83 are connected to a battery 85 through a control panel 84 including a control circuit and a drive circuit by means of a wire (not shown). The control panel 84 and battery 85 are mounted on a mounting plate 86 provided for the support base 70.

A footrest 87 is fixed to a bracket 8 of a column 5 of the chair body 1. A user U held by the body keeping apparatus 44 can put the user's feet on the footrest 87.

Moreover, a desk support member 9 for supporting a desk body 10 includes a support arm 88, and the support arm has a touch panel console 89. The console 89 is electrically connected to the control panel 84. When the user U performs an input operation such as the back-and-forth movement, side-to-side movement, and direction change of the chair body 1 through the console 89, the control panel 84 supplies a drive signal to the first and second motors 78*a* and 78*b*.

The functions of the chair according to the third embodiment will now be described.

The user U held by the body keeping apparatus 44 operates the console 89 by the hand and fingers to give an instruction to move the omnidirectional mobile unit of the chair 100.

Upon receiving a signal of forward movement from the console 89, the first and second motors 78*a* and 78*b* of the right-hand and left-hand mobile units 71 and 72 are supplied with a drive signal through the control circuit and drive circuit of the control panel 84. Since the output shafts 80*a* and 80*b* are opposed to each other, the first motors 78*a* of the right-hand and left-hand mobile units 71 and 72 are rotated clockwise and the second motors 78*b* thereof are rotated anticlockwise in synchronization with the first motors 78*a*. Thus, the wheels 81*a* and 81*b* rotate in the same direction and the casters 2 of the chair body 1 roll on the floor; accordingly, the chair 100 moves forward in the direction of arrow A.

When the console 89 transmits a signal of backward movement, the first and second motors 78*a* and 78*b* of the right-hand and left-hand mobile units 71 and 72 are supplied with a drive signal through the control circuit and drive circuit of the control panel 84. The first motors 78*a* of the right-hand and left-hand mobile units 71 and 72 are rotated anticlockwise and the second motors 78*b* thereof are rotated clockwise in synchronization with the first motors 78*a*. Thus, the wheels 81*a* and 81*b* rotate in the same direction and the casters 2 of the chair body 1 roll on the floor; accordingly, the chair 100 moves backward in the direction of arrow B.

When the console 89 transmits a signal of side-to-side movement, the first and second motors 78*a* and 78*b* of the right-hand and left-hand mobile units 71 and 72 are supplied with a drive signal through the control circuit and drive circuit of the control panel 84. The first and second motors 78*a* and 78*b* of the right-hand and left-hand mobile units 71 and 72 are rotated in the same direction. Thus, as indicated by a two-dot-one-dash line in FIG. 12, the wheels 81*a* and 81*b* rotate on the floor and the first and second motors 78*a* and 78*b* turn 90° around the direction changing shaft 76 together with the wheels 81*a* and 81*b* as one component.

When the encoder 83 detects that the first and second motors 78*a* and 78*b* rotate 90° around the direction changing shaft 76 together with the wheels 81*a* and 81*b* as one component, it supplies a drive signal to the first and second motors 78*a* and 78*b* of the right-hand and left-hand mobile units 71 and 72 through the control circuit and drive circuit of the control panel 84.

When the first motors 78*a* of the units 71 and 72 rotate clockwise and the second motors 78*b* thereof rotate anticlockwise in synchronization with the first motors 78*a*, the wheels 81*a* and 81*b* rotate in the same direction and the casters 2 of the chair body 1 roll on the floor. Thus, the chair 100 moves to the right (in the direction of arrow C in FIG. 13). To move the chair 100 to the left (in the direction of arrow D in FIG. 13), the first motors 78*a* have only to rotate anticlockwise and the second motors 78*b* have only to rotate clockwise in synchronization with the first motors 78*a*. The user U can move the chair 100 to-and-fro on the floor to meet the user's needs.

Furthermore, the first and second motors 78*a* and 78*b* of the right-hand and left-hand mobile units 71 and 72 can be rotated simultaneously or independently in an arbitrary direction, and they can be rotated 360° around the direction changing shaft 76 while the wheels 81*a* and 81*b* are rolling on the floor. If, therefore, the position of the chair 100 is changed by angle $\alpha$ with respect to point O shown in FIG. 13, the chair 100 can be moved to point E. The chair can thus quickly be moved to a target position.

Additional advantage and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A chair with a desk, including a body keeping apparatus, comprising:

a chair body;

a body keeping apparatus provided for the chair body to keep a body;

a support member coupled to the chair body turnably within a horizontal plane;

a desk body provided for the support member, a position of the desk body being adjustable back and forth with respect to the chair body;

a rest provided for the desk body and including a storage having a pair of extendable rails mounted therein, the rest having a top surface; and a drawer type rest supported by the extendible rails and thereby configured to be drawn from the rest in a lateral direction, the drawer type rest having a top surface, wherein a surface area of the top surface of the drawer type rest is substantially a same size as a surface area of the top surface of the rest, and wherein the body keeping apparatus includes a shoulder holding member which holds a shoulder of the body, a trunk holding member which holds a trunk of the body, and a crotch support member which supports a crotch of the body.

2. The chair according to claim 1, wherein the chair body includes a mounting member to and from which the body keeping apparatus is attachable and detachable.

3. The chair according to claim 1, wherein the chair body includes a mounting member by which a level of the body keeping apparatus is adjustable.

4. The chair according to claim 1, wherein the shoulder holding member, the trunk holding member, and the crotch support member are turnable in association with one another by a differential mechanism.

5. A chair with a desk, including a body keeping apparatus, comprising:

a chair body;

a body keeping apparatus provided for the chair body to keep a body, the body keeping apparatus including a pair of shoulder holding members configured to pivot about respective axes thereof from open positions to closed positions in which the pair of shoulder holding members are configured to hold shoulders of the body;

a support member coupled to the chair body turnably within a horizontal plane;

a desk body provided for the support member, a position of the desk body being adjustable back and forth with respect to the chair body;

a rest provided for the desk body and including a storage; and a drawer type rest which is allowed to be drawn from the rest in a lateral direction.

6. The chair according to claim 5, wherein said shoulder holding members are U-shaped.

7. The chair according to claim 5, wherein the body keeping apparatus further includes a crotch holding member configured to pivot from an open position to a closed position in which the crotch holding member is configured to hold a crotch of the body.

8. The chair according to claim 7, wherein said crotch holding member is U-shaped.

9. The chair according to claim 7, further comprising a main frame pivotally mounted on the body keeping apparatus, wherein the main frame is configured to actuate the shoulder holding members and the crotch holding member to move from their respective open positions to their respective closed positions when the main frame pivots from a first position to a second position.

10. The chair according to claim 5, wherein the body keeping apparatus further includes a pair of trunk holding members configured to pivot about respective axes from open positions to closed positions in which the pair of trunk holding members are configured to hold a trunk of the body.

11. The chair according to claim 10, further comprising a main frame pivotally mounted on the body keeping apparatus, wherein the main frame is configured to actuate the shoulder holding members, the crotch holding member, and the trunk holding members to move from their respective open positions to their respective closed positions when the main frame pivots from a first position to a second position.

12. The chair according to claim 5, further comprising a main frame pivotally mounted on the body keeping apparatus, wherein the main frame is configured to actuate the shoulder holding members to move from the open position to the closed position when the main frame pivots from a first position to a second position.

* * * * *